US007020974B2

(12) United States Patent
Danielli et al.

(10) Patent No.: US 7,020,974 B2
(45) Date of Patent: Apr. 4, 2006

(54) APPARATUS FOR CHECKING THE DIMENSIONAL AND GEOMETRIC FEATURES OF PINS

(75) Inventors: Franco Danielli, Zola Predosa (IT); Michele Gulinelli, Ferrara (IT); Gabriele Soattin, Ferrara (IT)

(73) Assignee: Marposs Societa' per Azioni, Bentivoglio (IT)

( * ) Notice: Subject to any disclaimer, the term of this patent is extended or adjusted under 35 U.S.C. 154(b) by 0 days.

(21) Appl. No.: 10/516,415

(22) PCT Filed: Jun. 2, 2003

(86) PCT No.: PCT/EP03/05740

§ 371 (c)(1),
(2), (4) Date: Dec. 2, 2004

(87) PCT Pub. No.: WO03/106108

PCT Pub. Date: Dec. 24, 2003

(65) Prior Publication Data

US 2005/0217130 A1 Oct. 6, 2005

(30) Foreign Application Priority Data

Jun. 12, 2002 (IT) ..... BO2002A0369

(51) Int. Cl.
*G01B 5/10* (2006.01)
*G01B 5/20* (2006.01)

(52) U.S. Cl. ..... 33/555.3; 33/550

(58) Field of Classification Search ..... 33/501.02, 33/501.03, 501.04, 543, 549, 550, 551, 552, 33/553, 554, 555, 555.1, 555.3
See application file for complete search history.

(56) References Cited

U.S. PATENT DOCUMENTS 1,941,456 A 1/1934 Arnold
6,088,924 A 7/2000 Esteve (Continued)

FOREIGN PATENT DOCUMENTS

EP 0 903 199 3/1999

(Continued)

*Primary Examiner*—G. Bradley Bennett
(74) *Attorney, Agent, or Firm*—Dickstein Shapiro Morin & Oshinsky LLP

(57) ABSTRACT

An apparatus for checking diameter and roundness of crankpins (42) in the course of the machining in a grinding machine, includes a Vee-shaped reference device (70), a gauging device with a movable feeler (67) associated with the Vee-shaped device (70) and a movable support (5, 40, 41, 60) device for the Vee-shaped reference device. The movable support device is coupled (5) to the grinding-wheel slide (1) and includes, in working condition, two parallelogram structures (40, 41) in series enabling substantially translation displacements of the Vee-shaped device (70). One of the two parallelogram structures (40, 41) includes an axially movable stem (32), with end surfaces (38, 39) that, in working condition, contact the external surface of bearings (15, 19), thereby setting the distance separating two of the four vertexes (11, 7, 14, 18) of the parallelogram (40), whereas when the apparatus is in the rest position, at least one of said end surfaces (38, 39) is separated from the surface of the associated bearing. During the checking, the direction of the feeler (67) displacements remains substantially unaltered.

12 Claims, 5 Drawing Sheets

U.S. PATENT DOCUMENTS

| | | | | |
|---|---|---|---|---|
| 6,430,832 | B1 * | 8/2002 | Dall'Aglio et al. | 33/555.1 |
| 6,643,943 | B1 * | 11/2003 | Dall'Aglio et al. | 33/555.3 |
| 6,848,190 | B1 * | 2/2005 | Dall'Aglio et al. | 33/555.3 |
| 6,952,884 | B1 * | 10/2005 | Danielli | 33/555.1 |

FOREIGN PATENT DOCUMENTS

| | | |
|---|---|---|
| EP | 1 118 833 | 7/2001 |
| WO | WO 02/070195 | 9/2002 |

* cited by examiner

APPARATUS FOR CHECKING THE DIMENSIONAL AND GEOMETRIC FEATURES OF PINS

TECHNICAL FIELD

The present invention relates to an apparatus for checking dimensional and geometric features of a pin, rotating about a geometric axis of rotation, with a Vee-shaped reference device that defines rest and reference surfaces adapted for cooperating with the pin to be checked, a gauging device, coupled to the Vee-shaped reference device and including a feeler adapted for contacting the surface of the pin to be checked and for performing linear displacements along a measurement direction lying between the rest and reference surfaces of the Vee-shaped reference device, a support device for supporting the Vee-shaped reference device and the gauging device, with a stationary support element and a coupling mechanism, between the stationary support element and the Vee-shaped reference device, and a control device for enabling the apparatus to displace in an automatic way from a rest position to the working condition, and vice versa.

BACKGROUND ART

Apparatuses for the crankpin diameter checking of a crankshaft rotating with orbital motion about a geometric axis in the course of the machining in a grinding machine are disclosed in international patent application published with No. WO-A-9712724, filed by the same applicant of the present patent application.

More specifically, according to the embodiments shown and described in the previously detailed international patent application, the apparatuses have Vee-shaped reference devices that rest on the crankpin to be checked and maintain correct cooperation with the surface of the crankpin substantially by virtue of the force of gravity.

The embodiments disclosed in the formerly detailed international patent application guarantee excellent metrological results and small forces of inertia and the standards of performance of the apparatuses with these characteristics, manufactured by the applicant of the present patent application, confirm the remarkable quality and reliability of the applications.

Furthermore, these known apparatuses can be utilized for carrying out roundness checkings of the cylindrical surfaces of the pins, while the crankshaft is assembled and rotating on the grinding machine.

International patent application published with No. WO-A-0166306, also filed by the same applicant of the present patent application, relates to an apparatus and a method for checking the roundness of crankpins in orbital rotation on a grinding machine. This international patent application discloses the detecting of diameter dimensions of the crankpin, at predetermined angular positions during the crankshaft rotation, by means of a gauging head including a feeler and Vee-shaped reference surfaces that rest on the piece and a transducer that detects displacements of the feeler along a direction of measurement coincident with the bisecting line of the Vee or slightly sloping with respect to it.

The detected dimensions are processed for both compensating distorsions due to the geometric features of the particular type of head used (modulation of the shape errors of the checked surface that is in contact with the reference Vee) and carrying out other compensations for keeping into account the position taken by the head on the surface of the crankpin, more specifically the angular arrangement of the instantaneous point of contact of the feeler with respect to a known reference, that depends on the relative arrangement between the support element and the crankshaft and on the characteristics and consequent configurations taken by the support device carrying the head. FIGS. 1*a* and 1*b* show, in an extremely simplified form, some parts of an apparatus according to the previously detailed patent application published with No. WO-A-0166306, coupled to the grinding-wheel slide of a grinding machine, in the course of checkings of a cylindrical crankpin. In order to evidence how the angular arrangement of the measurement direction D defined by feeler T depends on the mutual position between the piece to be checked and the coupling area of the apparatus, FIGS. 1*a* and 1*b* show two different checking conditions. In the first condition (FIG. 1*a*) the apparatus checks the pin while the latter is in contact with the grinding wheel, in the second condition (FIG. 1*b*) the grinding-wheel slide is retracted from the piece. Consideration should also be given to the fact that, in the course of the checking of a pin in orbital motion (for example a crankpin), variations in the configuration of the support device cause consequent variations in the angular arrangement of the feeler.

The method according to international patent application published with No. WO-A-0166306 enables to achieve excellent results notwithstanding the unavoidable approximations due to the various processings that depend on the theoretic behavior of the involved mechanic component parts.

International patent application published with No. WO-A-02070195, also filed by the same applicant of the present patent application, illustrates and describes apparatuses that can as well be utilized for checking the dimensions and the roundness of pins in orbital rotation on a grinding machine and have the characteristics detailed at the beginning of the present description. More specifically, the disclosed apparatuses include coupling mechanisms carrying the Vee-shaped device, with movable coupling elements that enable substantially translation displacements of the Vee-shaped device with respect to the support element.

FIGS. 2*a* and 2*b* show, in simplified form, an apparatus according to international patent application published with No. WO-A-02070195, coupled to the grinding-wheel slide of a grinding machine, in the course of checkings of a cylindrical crankpin. It is possible to notice that the angular arrangement of the measurement direction D, along which feeler T translates, does not vary as the configuration taken by the coupling mechanism varies, the latter having coupling elements defining, for example, two parallelogram structures. This enables to know—beforehand and regardless of the reciprocal position between support element and workpiece to be checked—the angular position of the instantaneous point of contact at which the feeler touches the surface of the piece to be checked. In this way in the event it is required to utilize the apparatus for performing, for example, roundness checkings, at least part of the processings of the detected values—required for checkings carried out with the apparatuses known, for example, from international patent application published with No. WO-A-0166306—are not necessary, and this enables, among other things, to minimize the approximations in the calculations and provide more rapid and reliable checking operations.

DISCLOSURE OF INVENTION

An object of the present invention is to provide an apparatus for checking dimensional and geometric features of cylindrical parts that, in addition to some of the functional characteristics of the apparatuses disclosed in international patent application published with No. WO-A-02070195—characteristics that guarantee excellent performances insofar as accuracy and reliability are concerned—has manufacturing aspects that make the use particularly easy and advantageous in the in-process checking during the machining in a machine tool, ensuring limited overall dimensions, especially in rest conditions.

This object is achieved and the hereinafter disclosed advantages are attained by a checking apparatus according to claim 1.

BRIEF DESCRIPTION OF THE DRAWINGS

A preferred embodiment of the invention is now described in more detail with reference to the enclosed sheets of drawings, given by way of non-limiting example, wherein.

BEST MODE FOR CARRYING OUT THE INVENTION

Figure 3:
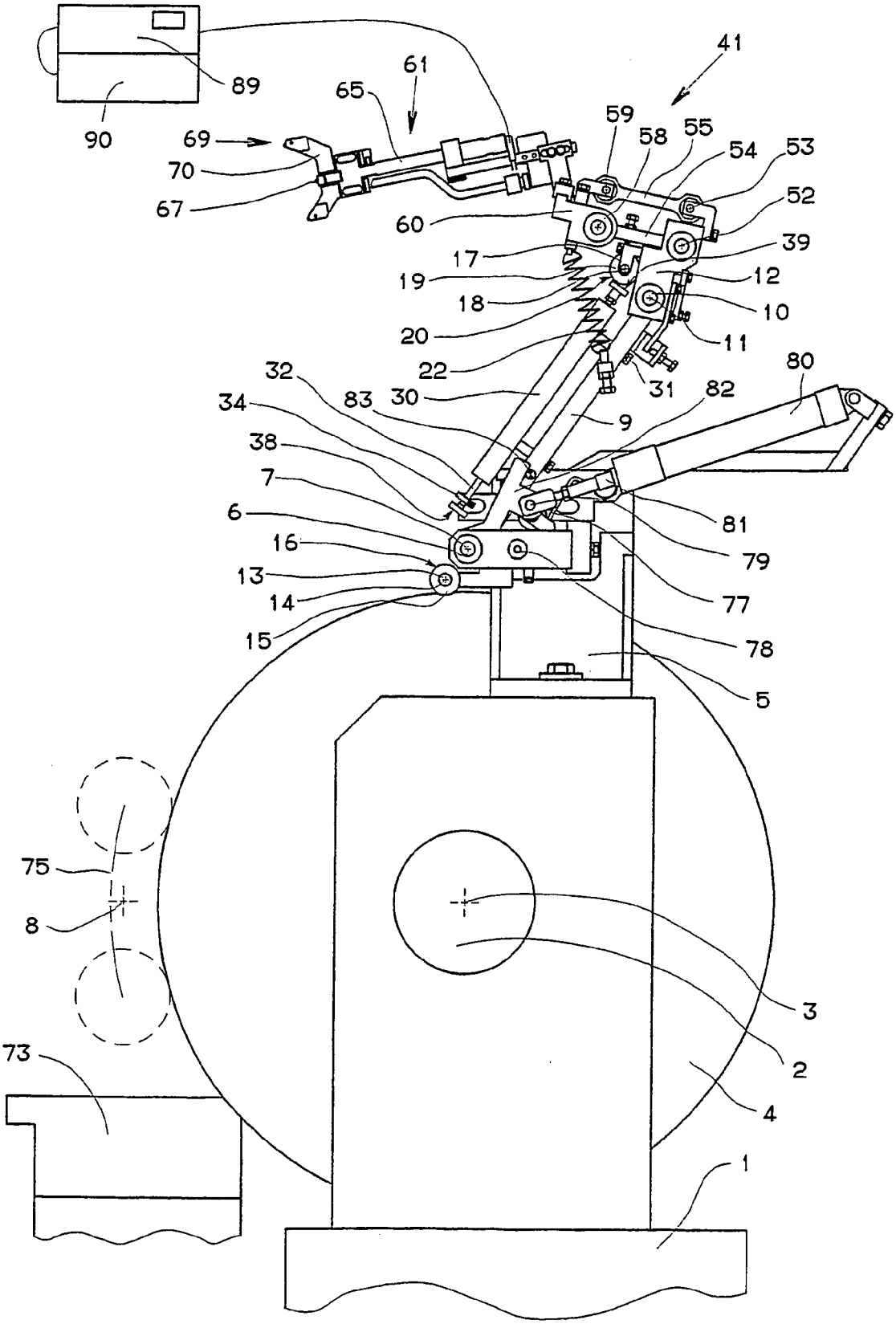
FIG. 3 is a side view of a checking apparatus according to a preferred embodiment of the invention, mounted on the grinding-wheel slide of a crankshaft grinding machine, shown in rest conditions.
Figure 4:
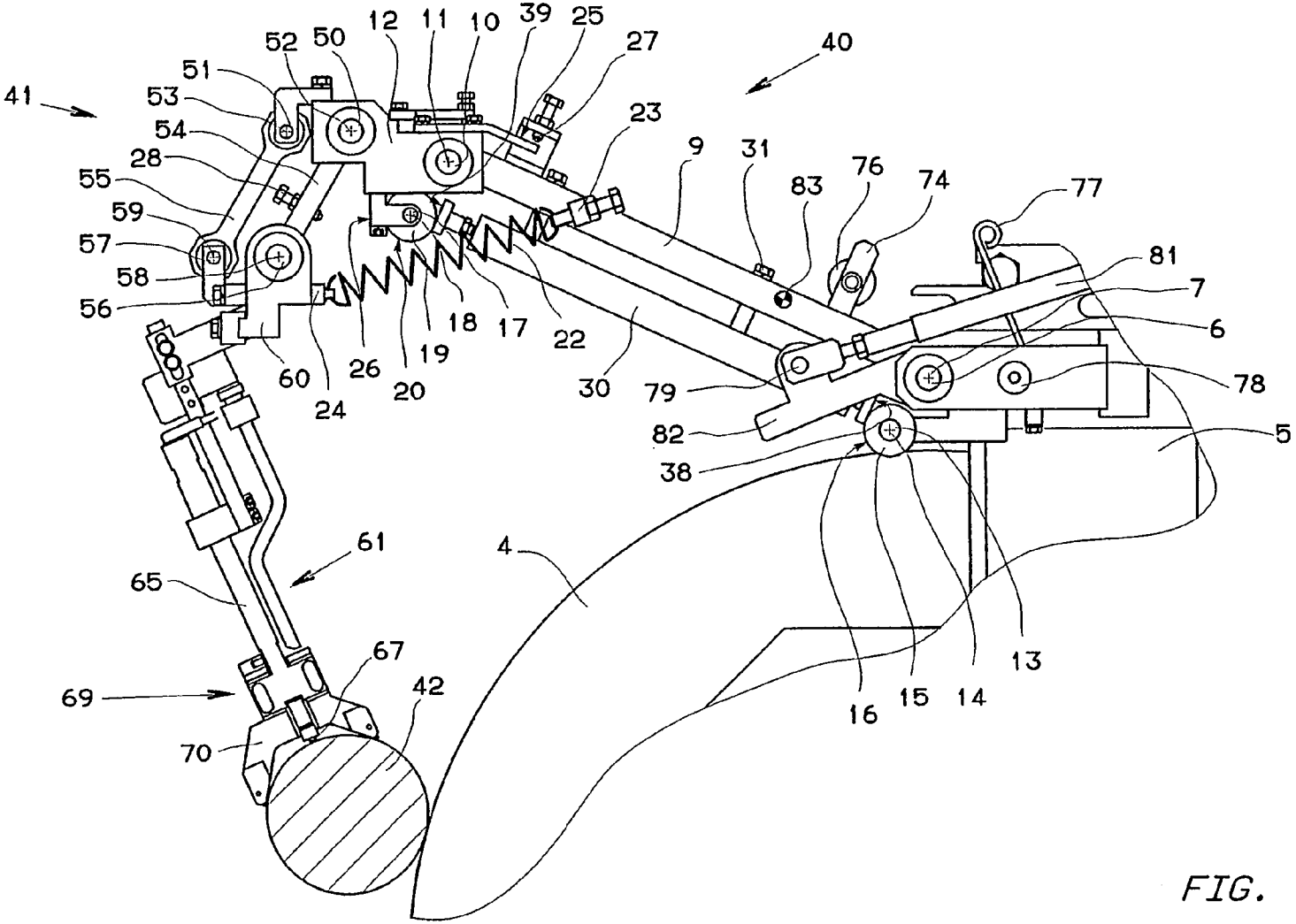
FIGS. 4 and 5 are partial and enlarged side views of the apparatus of FIG. 3 shown in working condition, at different moments in time during the checking of a crankpin while it is being machined.
Figure 5:
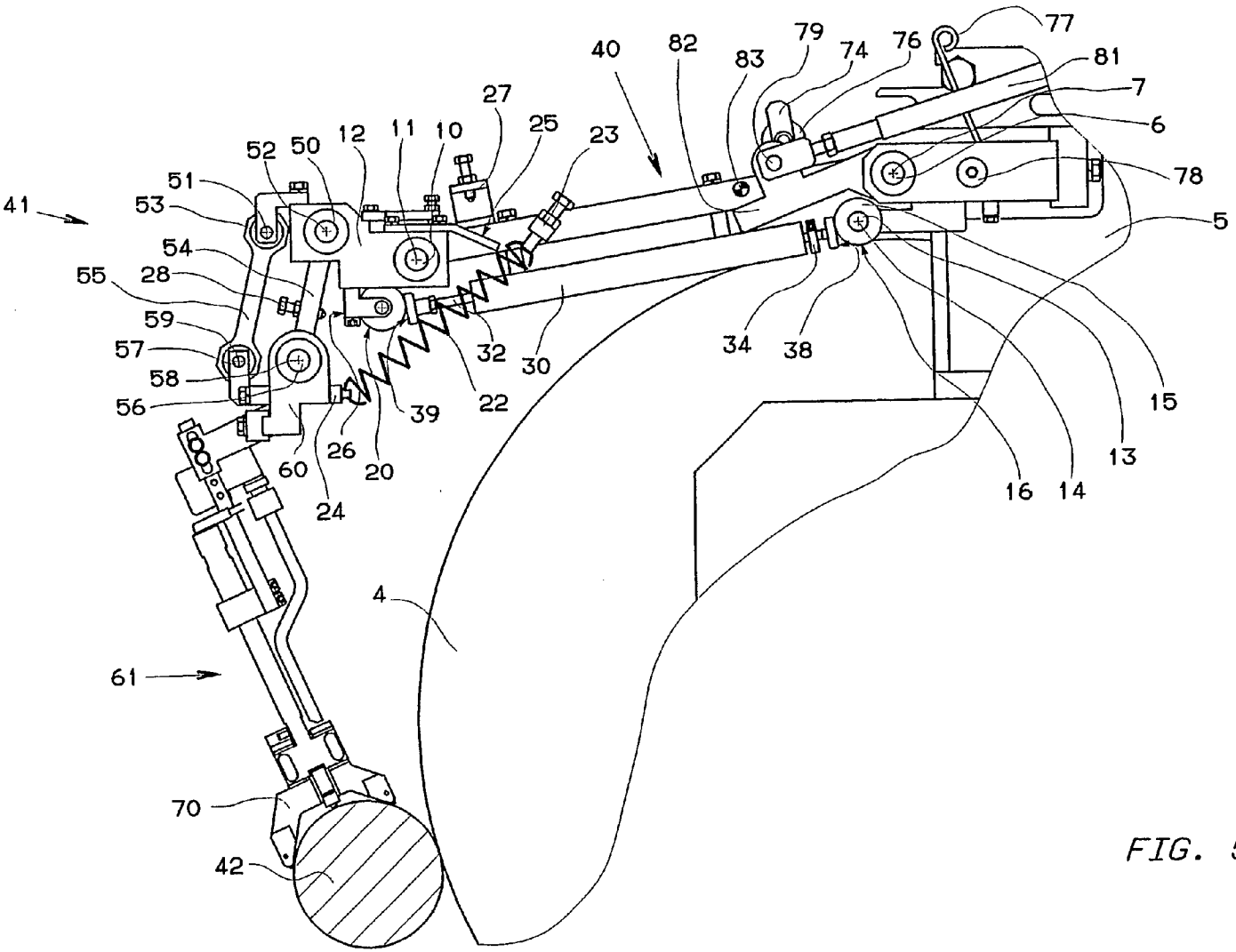

With reference to FIGS. 3, 4 and 5, the grinding-wheel slide 1 of a computer numerical control ("CNC") grinding machine for grinding a crankshaft supports a spindle 2 that defines the axis of rotation 3 of the grinding wheel 4. The grinding-wheel slide 1 carries a support device with a stationary support element 5 and a coupling mechanism including a plurality of coupling elements. More specifically, the support element 5 supports, by means of a first rotation pin 6, a first rotating, coupling element 9. Pin 6 defines a first axis of rotation 7 parallel to the axis of rotation 3 of grinding wheel 4 and to the geometric axis of rotation 8 of the crankshaft to be checked. In turn, coupling element 9 supports an intermediate element 12, by means of a second rotation pin 10 that defines a second axis of rotation 11 parallel to axes 3 and 8. A third rotation pin 13 is stationary with respect to the support element 5, defines a third axis of rotation 14 parallel to axes 3, 8 and 11, and supports a first bearing 15 of a known type, with an external cylindrical surface 16. A fourth rotation pin 17 is fixed to the intermediate element 12, defines a fourth axis of rotation 18, parallel to axes 3, 8, 11 and 14, and supports a second bearing 19, identical to the first (15), with an external cylindrical surface 20.

Figure 6:
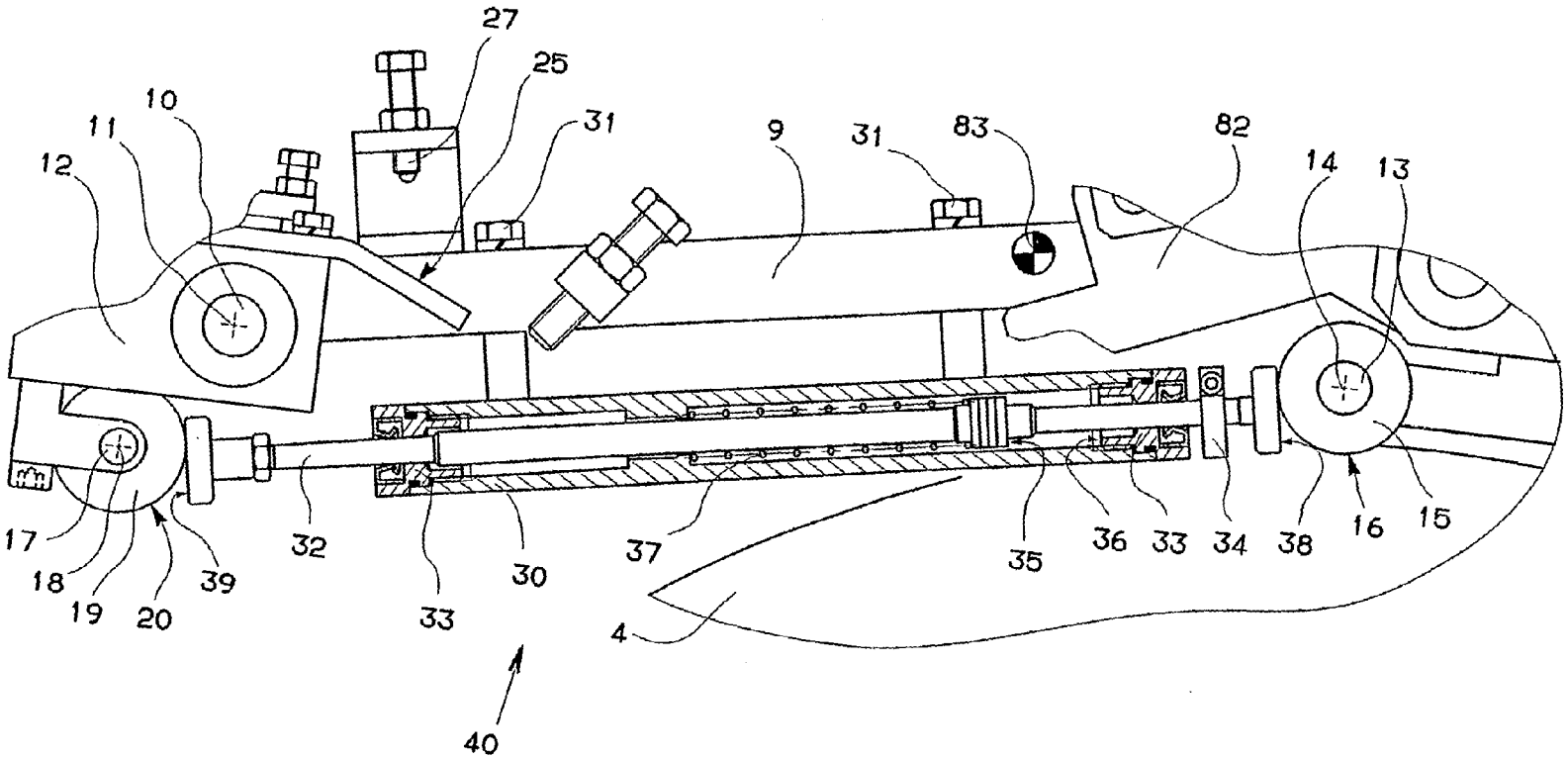
FIG. 6 is a partial and furtherly enlarged side view of some component parts of the apparatus of FIG. 5.

A limiting device includes a tubular support and guide element 30, fixed to the first coupling element 9 by means of screws 31 and arranged parallel to said element 9, and a rigid elongate element or stem 32, partially housed at the interior of tubular element 30. The stem 32 is guided to perform axial translations—along a direction substantially parallel to the first coupling element 9—by two bushings 33 arranged at the interior of the tubular element 30 and shown in FIG. 6. Furthermore, FIG. 6 shows internal abutment surfaces 35 and 36 that limit in one direction the amount of the axial translations between stem 32 and tubular element 30, and a compression spring 37 for keeping the surfaces 35 and 36 urged against each other when there are no external stresses. The translation displacements between stem 32 and tubular element 30 are also limited—in the opposite direction—by an abutment ring 34 coupled, in an adjustable way, to an area of stem 32 external to element 30. Each of the ends of stem 32 protrudes towards the exterior of the tubular element 30 and has a mechanical abutment plane surface 38 (and 39), substantially perpendicular with respect to the axis of stem 32. When the apparatus is in the working condition as shown, for instance, in FIGS. 4 and 5, two pairs of mechanical abutments are defined by the plane surfaces 38 and 39 that are in contact with the cylindrical surfaces 16 and 20 of bearings 15 and 19, respectively, thereby determining the distance between the axes 14 and 18. The dimensions of bearings 15 and 19 and those of stem 32 are such that the so determined distance is equal to that existing between axes 7 and 11, the latter being defined by the first coupling element 9. In practice, in the working condition, the first coupling element 9, the stationary support element 5, the intermediate element 12 and the limiting device including stem 32 and bearings 15 and 19 define a first parallelogram structure 40 that represents a first section of the coupling mechanism.

A fifth rotation pin 50 and a sixth rotation pin 51 are rigidly coupled to the intermediate element 12 and define a fifth and a sixth axis of rotation 52 and 53, respectively, parallel to the previously mentioned axes of rotation. Two further coupling elements 54 and 55 have ends coupled, by means of the rotation pins 50 and 51, respectively, with the intermediate element 12. A movable support 60 carries a seventh rotation pin 56 and an eighth rotation pin 57—that define a seventh and an eighth axis of rotation 58 and 59, respectively, parallel to the previously detailed axes of rotation—and is coupled to the intermediate element 12 by the two further coupling elements 54 and 55, the latter having ends coupled to rotation pins 56 and 57.

The two further coupling elements 54 and 55, together with the intermediate element 12 and the movable support 60, define a second parallelogram structure 41 that represents a second section of the coupling mechanism.

An elastic thrust device with a return closing spring 22 is coupled to hooking elements 23 and 24, the latter being coupled to the first coupling element 9 and to the movable support 60, respectively, the hooking element 23 being adjustable for setting the force of the spring 22. The intermediate element 12 carries a first (25) and a second (26) abutment surface, while adjustable abutment elements 27 and 28 are coupled to the first coupling element 9 and to one (54) of the further coupling elements, respectively. Contact between the adjustable abutment elements 27 and 28 and the abutment surfaces 25 and 26, respectively, limits the amount of reciprocal rotational displacements among the elements of the coupling mechanism, urged by the thrust of spring 22, more specifically at the rest position shown in FIG. 3.

An abutment jut 74 is rigidly coupled to the first coupling element 9 and can cooperate with a surface of the stationary support element 5 for defining the rest position of the apparatus (FIG. 3).

To the movable support 60 there is rigidly coupled—in an adjustable way according to a per se known coupling herein not detailedly described—a gauging device 61 including a guide casing 65 wherein there can axially translate a transmission rod carrying a feeler 67 for contacting the surface of a crankpin 42 to be checked. The displacements of the rod are detected, for example, by a transducer of the LVDT type (Linear Variable Differential Transducer) or HBT type (Half Bridge Transformer), per se known and not shown in the figures. At the lower end of the guide casing 65 there is coupled a support block 69 that supports a Vee-shaped reference device 70, with rest and reference surfaces for engaging the surface of crankpin 42 to be checked. Feeler 67 and the transmission rod are movable substantially along a measurement direction D (FIGS. 2*a* and 2*b*) that coincides with the bisecting line of the Vee-shaped reference device 70, or is slightly angularly displaced with respect to it—as in the embodiment of the "asymmetric" Vee shown in FIGS. 3 to 5—but in any case crosses the Vee-shaped device 70 between the associated rest and reference surfaces. The transducer signals are transmitted to processing and display devices 89, in turn connected to the numeric control of the grinding machine 90, shown in simplified form in FIG. 3. The use of the asymmetric Vee-shaped device 70 in an apparatus according to the present invention for performing roundness checkings is of great advantage, as it increases sensitivity thereby permitting the checking of cylindrical surfaces with shape errors in a broad range of lobings, as more detailedly described in the formerly mentioned international patent application published with No. WO01/66306.

A crankshaft to be checked is positioned on the worktable 73 between a spindle and a tailstock, not shown, that define the geometric axis of rotation 8, coincident with the main geometric axis of the crankshaft. As a consequence, crankpin 42 orbitally rotates about axis 8. Although crankpin 42 eccentrically rotates about axis 8, by describing a circular trajectory, the trajectory of the pin relative to the grinding-wheel slide 1 in the course of the machining can be represented, in practice, by the arc shown in FIG. 3 with a dashed line and identified by reference 75.

So, when the Vee-shaped reference device 70 rests on the crankpin 42, it describes a similar trajectory, with a reciprocating motion from up to down and vice versa and at a frequency equal to that of the orbital motion of crankpin 42 (some tens of revolutions per minute). This is due to the fact that the checking apparatus is carried by the grinding-wheel slide 1 that—in modern, numerical control grinding machines—machines the crankpins while they are orbitally rotating, by "tracking" the crankpins so as to keep the grinding wheel in contact with the surface to be ground. Obviously, a feed motion for the stock removal is added to the transversal "tracking" motion. Thus, the displacements of the elements forming the checking apparatus involve relatively small forces of inertia, to the advantage of the metrological performance, limited wear and reliability of the apparatus.

A control device, shown in its entirety in FIG. 3 and only partially in FIGS. 4, 5 and 6, includes a double-acting cylinder 80, for example of the hydraulic type. Cylinder 80 is supported by the grinding-wheel slide 1 and includes a rod 81, coupled at one end to the piston of cylinder 80 and at the other end, by means of a rotation pin 79, to an intermediate portion of a movable element, more specifically a lever 82, the latter being in turn coupled, at an end and by means of the rotation pin 6, to the support element 5. When cylinder 80 is activated for displacing the piston and retracting the rod 81 to the right (with reference to the figures), lever 82 rotates in a clockwise direction (with reference to the figures) about pin 6, and the free end of the lever 82 contacts an abutment pin 83, coupled to the first coupling element 9, causing the latter to rotate in a clockwise direction and the checking apparatus to displace to the rest position shown in FIG. 3. A torsional spring 77 is wound to an anchor pin 78, coupled to the stationary support element 5, and has a free bent end. In the course of the displacement of the apparatus towards the rest position, the bent end of spring 77 contacts an idle wheel 76 integral with the first rotating, coupling element 9, more specifically fixed to the abutment jut 74, that urges it—as in the arrangement of the figures—towards the right. The spring 77, wound to pin 78, loads in the course of said displacement and, when the apparatus is in the rest position, applies a force to element 9 opposing that applied by the control device. In the course of said displacement, the abutment surfaces 25 and 26 come into abutment against elements 27 and 28, urged by the force of spring 22.

Furthermore, the cylindrical surface 20 of bearing 19 rests on the plane surface 39 of stem 32 (in turn constrained with respect to the tubular element 30 by the abutment between the internal surfaces 35 and 36), and thus there is defined and set a minimum value of the angles between the intermediate element 12 and the coupling elements 9 and 54, respectively.

The retraction of the checking apparatus to the rest position is normally controlled by the grinding machine numerical control when it detects, on the ground of the measuring signal provided by the checking apparatus, that crankpin 42 has reached the required (diametral) dimension. Thereafter, the machining of other parts of the crankshaft takes place, or—in the event the machining of the crankshaft has been completed—the piece is unloaded, manually or automatically, and a new piece is loaded on worktable 73.

When a new crankpin has to be machined, it is brought in front of grinding wheel 4, typically by displacing the worktable 73 (in the case of a grinding machine with a single grinding wheel), and the apparatus displaces to the checking condition. This occurs by controlling, by means of the grinding machine numerical control, cylinder 80 so that rod 81 displaces towards the left (with reference to the figures). Thus, the free end of lever 82 (that rotates in a counterclockwise direction about rotation pin 6) releases the force applied to the abutment pin 83 and the thrust of spring 77 prevails and causes a rotation in a counterclockwise direction of the coupling element 9 and of the entire system including the coupling mechanism, the reference device 70 and the gauging device 61. The thrust of spring 77 diminishes in the course of said rotation, and when the center of gravity of the rotating system moves beyond the vertical plane on which the first axis 7 lies, the rotation about said axis 7, that displaces the Vee-shaped device 70 on the crankpin 42 to be checked continues as a consequence of the force of gravity, which is the force that thereafter keeps device 70 and the surface of crankpin 42 in contact when the apparatus is in working conditions, in other terms in the course of the checking operations.

In a first phase of the displacement from the rest position, the coupling elements 9 and 54 and 55 rotate integrally about the axis of rotation 7 by virtue of the contact that spring 22 holds between the abutment elements 27 and 28 and the associated surfaces 25 and 26, likewise that between bearing 19 and stem 32. As previously mentioned, in this phase the position of stem 32 in the tubular element 30 is defined by the resting of the internal abutment surfaces 35 and 36 urged by the thrust of spring 37. When a rotation of a predetermined amount has taken place and the support block 69 is approaching crankpin 42—in orbital motion—and grinding wheel 4, the other plane mechanical abutment surface 38 of stem 32 touches surface 16 of bearing 15, in this way defining the first parallelogram structure 40 characterized by the pairs of axes 7+11, about which the coupling element 9 rotates, and 14+18, the mutual distance of which is set by stem 32. The distance between axes 7 and 14 and that between axes 18 and 11 are determined by the position of the associated pins 6, 13 and 17, 10 on the stationary element 5 and on the intermediate element 12, respectively.

As the lowering movement of the support device continues, the abutment element 27 disengages from surface 25 of element 12 and, upon contact of the Vee-shaped device 70 with the crankpin 42 to be checked, element 28 and surface 26 also disengage.

If the reference device 70 fails to contact the crankpin 42 to be checked, the lowering movement towards grinding wheel 4 is stopped before a collision occurs with the latter by virtue of the contact that the abutment ring 34 and an end of the tubular element 30 provide. In substance, such contact limits the mutual sliding between stem 32 and the tubular element 30 and in this way stops the displacement that is taking place in the parallelogram structure 40 (displacements of the second parallelogram structure 41 are still prevented in this phase by the abutment of element 28 against surface 26).

According to a possible modification of the apparatus illustrated in the figures, pin 13, carrying bearing 15, is coupled to the stationary element 5 in order to take two different positions and there is provided an automatic, for example pneumatic, device for switching from one to the other position. More specifically, according to this modification (not shown in the drawings), under working conditions bearing 15 is in the same position illustrated in the figures for defining the parallelogram structure 40, while, in the course of the switching from the rest position to the working condition herein previously described, pin 13 is translated to the left (according to the arrangement shown in FIGS. 3–6). In this way the gauging device 61 approaches towards crankpin 42 guided along a trajectory that is farther away from grinding wheel 4 and consequently safer. This possible modification is particularly advantageous in those applications in which, owing to the dimensions of the parts and the clamping position of the support device, the risks of the gauging device 61 possibly colliding against grinding wheel 4 or other elements of the apparatus, in the course of the displacements towards the crankpin 42 and away from it, are potentially high.

As previously described, the correct cooperation between crankpin 42 and reference device 70 is held, in the course of the checking phase, by virtue of the displacements of the various component parts of the coupling mechanism that includes the two parallelogram structures 40 and 41 and the intermediate element 12. These displacements are caused by the force of gravity and by the thrust applied by the crankpin 42 in opposition to said force of gravity. In the course of the checking phase, spring 37, located at the interior of tubular element 30, applies, by virtue of its elastic characteristics, an action that tends to dynamically counterbalance the weight of the apparatus, thereby opposing possible negative effects due to the force of inertia.

The parallelogram structures enable substantially translational displacements of the guide casing 65 and of the Vee-shaped reference device 70 coupled to it, in other terms enable to keep unaltered the angular arrangement of the measurement direction D along which feeler 67 displaces, regardless of the configuration taken by the various component parts of the coupling mechanism.

Figure 1A:
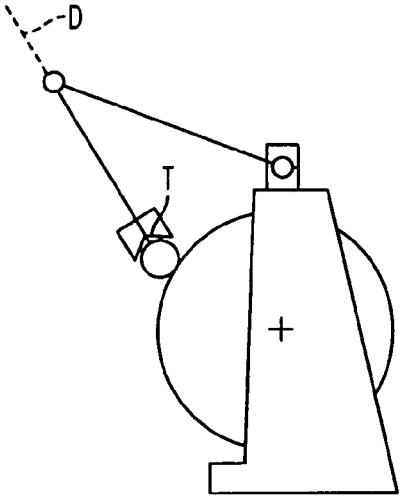
FIG. 1A PRIOR ART
FIGS. 1*a* and 1*b* show, in simplified form, the arrangement of a known apparatus under two different working conditions.
Figure 1B:
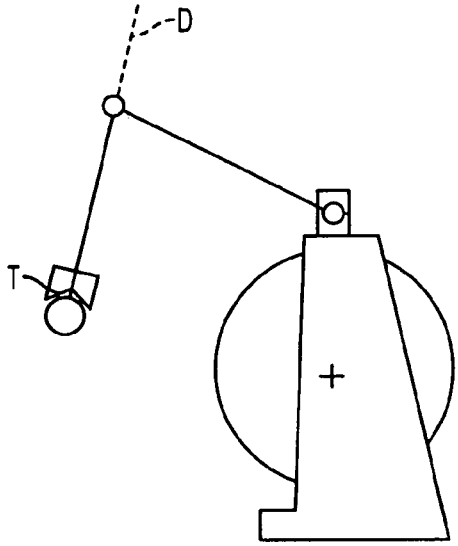
FIG. 1B PRIOR ART
Figure 2A:
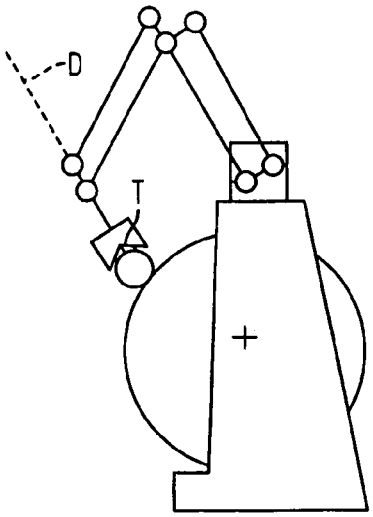
FIGS. 2*a* and 2*b* show, in simplified form, the arrangement of a different known apparatus, including some of the functional aspects according to the present invention, illustrated under the two different working conditions shown in FIGS. 1*a* and 1*b;*
Figure 2B:
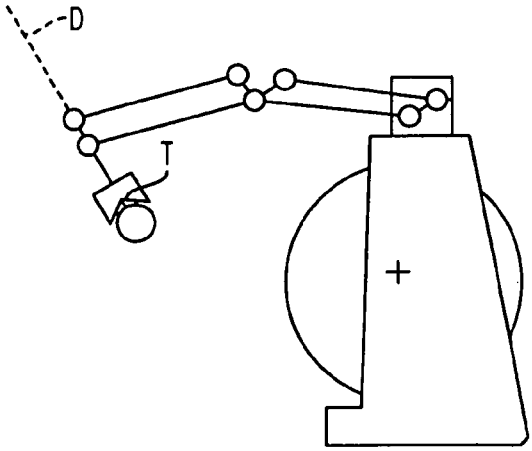

This facilitates, among other things, the checking of the roundness characteristics of the orbitally rotating crankpin, because, as the angular arrangement of the instantaneous point of contact between feeler and surface of the pin is known and constant (as shown in the sketches of FIGS. 2*a* and 2*b*), the values detected by the gauging device 61 need not undergo the associated compensations mentioned in the first part of this description. In practice, the detected values do not depend on the relative position between the support element 5 and the checked crankshaft and on the characteristics and consequent configurations taken by the support device to which the gauging device 61 is coupled.

In addition to these positive aspects, already encompassed in the embodiments disclosed in international patent application published with No. WO-A-02070195, the structure of the apparatus according to the present invention improves the flexibility of use and renders more simple applications for in-process checkings on machine tools.

In fact, configurations with rotating assemblies in which the sides of the parallelograms are connected to the fulcrum means that achieve the axes of rotation, do not allow great freedom in defining the rest position, considerably limiting the possibilities of displacement of the coupling mechanism (as, for example, the position taken by the Vee-shaped reference device in the embodiment according to FIG. 7 in patent application published with No. WO-A-02070195).

The possibility of disassembling and assembling one of the two parallelogram structures in a safe, simple, rapid and automatic way, by virtue of the displacing from and the contacting between mechanical surfaces (16, 38) of a suitable limiting device (30, 32), offers many advantages in terms of how important it is for the apparatus to rapidly and automatically switch from a working condition to a rest position and vice versa, and have small layout dimensions in the rest position and be sufficiently distant from the area where the grinding wheel 4 machines the piece, for facilitating the workpiece loading/unloading operations and providing greater protection to the more delicate parts of the checking system.

In practice other embodiments falling within the scope of the invention can foresee, for example, that the coupling mechanism of the support device includes two support sections coupled "in series" and each of the two sections defines constraints that allow just plain reciprocal translation displacements among the coupled parts, and at least one of the two sections includes a pair of mechanical abutments that do not contact in the rest position and contact each other in the working condition for achieving a parallelogram structure. The other section of the support device can be a parallelogram structure, as the one (41) shown in the figures, or a different known coupling with the hereinbefore detailed characteristics, as for example those described and illustrated in patent application published with No. WO-A-02070195 (slides, couplings with pulleys interconnected by belts that constrain their angular displacements, or other).

Other possible variants with respect to what has been herein described and illustrated can also regard the structure and the arrangement of the control device, the use of limiting devices with abutment surfaces (for example for limiting in the rest position the reciprocal rotations among the various parts of the support device), a different embodiment of the elastic thrust device (for example by means of two or more springs that replace spring 22 and are coupled between the intermediate element 12 and different coupling elements), and/or other.

A guide or raiser mechanism for granting a smooth introduction of the Vee-shaped reference device 70 on the surface of the pin 42 can also be added, with respect to what is shown in the figures. Such raiser mechanism includes, for instance, a roller coupled at an end of the Vee-shaped device, close to the rest and reference surface coming first in contact with the pin 42.

An apparatus according to the invention is particularly suitable for the in-process checking of crankpins in orbital motion, but obviously can be utilized for dimensional or shape checkings of orbitally rotating pins before or after the machining, as well as for checkings (before, during or after the machining) of pins rotating about their axes of symmetry.

What is claimed is:

1. An apparatus for checking dimensional and geometric features of a pin, rotating about a geometric axis of rotation, with a Vee-shaped reference device that defines rest and reference surfaces adapted for cooperating with the pin to be checked, a gauging device, coupled to the Vee-shaped reference device and including a feeler adapted for contacting the surface of the pin to be checked and for performing linear displacements along a measurement direction lying between said rest and reference surfaces of the Vee-shaped reference device, a support device for supporting the Vee-shaped reference device and the gauging device, with a stationary support element and a coupling mechanism, between the stationary support element and the Vee-shaped reference device, adapted for enabling, when the apparatus is in a working condition, substantially translation displacements of the Vee-shaped reference device with respect to the stationary support element, the coupling mechanism including:

a first section coupled to the stationary support element, an intermediate element coupled to the first section, and a second section coupled to the intermediate element and carrying the Vee-shaped reference device and the gauging device, at least one of said first and second sections including, in said working condition, a first substantially parallelogram structure with four fulcra that define as many axes of rotation parallel to said geometric axis of rotation and coupling and limiting elements adapted for defining and setting a distance separating adjacent axes of rotation, said first substantially parallelogram structure including at least one pair of mechanical abutments adapted for holding mutual contact in said working condition for defining and setting the distance separating two adjacent axes of rotation, and for remaining mutually separate in said rest position of the apparatus, and a control device for enabling the apparatus to displace in an automatic way from a rest position to said working condition, and vice versa.

2. The apparatus according to claim 1, wherein said first substantially parallelogram structure includes an additional pair of mechanical abutments adapted for holding mutual contact in said working condition.

3. The apparatus according to claim 2, wherein said coupling and limiting elements include at least an elongate coupling element defined between two adjacent fulcra and a stem arranged—in said working condition—between the other two fulcra, the stem being coupled to said elongate element and arranged, in an axially movable way along a direction substantially parallel to said elongate element, the ends of said stem and elements integral with said other two fulcra defining the mechanical abutments of said at least one and additional pairs.

4. The apparatus according to claim 3, wherein said elements integral with said other two fulcra are bearings with associated external cylindrical surfaces that define mechanical abutments of said at least one and additional pairs.

5. The apparatus according to claim 3, wherein the coupling and limiting elements include a support and guide element with a substantially tubular shape, fixed to said elongate coupling element and adapted for housing the stem and guiding its displacement.

6. The apparatus according to claim 5, wherein the displacement of the stem with respect to the support and guide element is limited by internal abutment surfaces defined at the interior of said support and guide element, a spring being provided for urging said internal abutment and surfaces into mutual contact when the apparatus is in the rest position.

7. The apparatus according to claim 6, wherein the displacement of the stem with respect to the support and guide element is limited by an abutment ring adjustably coupled to the stem, at the exterior of said support and guide element.

8. The apparatus according to claim 2, wherein the mechanical abutments of said additional pair are adapted to be in mutual contact when the apparatus is in the rest position.

9. The apparatus according to claim 1, wherein the other of said first and second section includes a second substantially parallelogram structure.

10. The apparatus according to claim 9, wherein said second substantially parallelogram structure includes two additional coupling elements and two pairs of fulcra that define four axes of rotation parallel to said geometric axis of rotation.

11. The apparatus according to claim 1, wherein said support device includes an elastic thrust device located between the elements of the first and the second section and adapted for applying a force of reciprocal attraction between said first and second section.

12. The apparatus according to claim 1, for checking the diameter and the roundness of a pin orbitally rotating about a geometric axis of rotation, in the course of the machining in a numeric control grinding machine including a worktable defining said geometric axis and a grinding-wheel slide carrying a grinding wheel, wherein said stationary support element is coupled to the grinding-wheel slide.

* * * * *